US011035286B2

(12) United States Patent
Mark et al.

(10) Patent No.: US 11,035,286 B2
(45) Date of Patent: Jun. 15, 2021

(54) COOLANT RESERVOIR TANK

(71) Applicant: ILLINOIS TOOL WORKS INC., Glenview, IL (US)

(72) Inventors: Dennis Matthew Mark, Buffalo Grove, IL (US); Joseph Kuhn, Des Plaines, IL (US); Louis Sigioltzakis, Des Plaines, IL (US); Serge Iafrate, Montmerle sur Saone (FR)

(73) Assignee: Illinois Tool Works Inc., Glenview, IL (US)

( * ) Notice: Subject to any disclaimer, the term of this patent is extended or adjusted under 35 U.S.C. 154(b) by 26 days.

(21) Appl. No.: 16/210,861

(22) Filed: Dec. 5, 2018

(65) Prior Publication Data

US 2019/0170053 A1 Jun. 6, 2019

Related U.S. Application Data

(60) Provisional application No. 62/594,570, filed on Dec. 5, 2017, provisional application No. 62/599,898, filed on Dec. 18, 2017.

(51) Int. Cl.
*F01P 7/16* (2006.01)
*F01P 11/02* (2006.01)

(52) U.S. Cl.
CPC ..... *F01P 11/029* (2013.01); *F01P 7/165* (2013.01); *F01P 2050/24* (2013.01); *F01P 2050/30* (2013.01)

(58) Field of Classification Search
CPC ..... F01P 7/165; F01P 11/02; F01P 11/028; F01P 11/029; B65D 25/04
(Continued)

(56) References Cited

U.S. PATENT DOCUMENTS 3,752,132 A * 8/1973 Bentz ..... F01P 7/165 123/563
5,357,909 A * 10/1994 Attinger ..... F01P 11/0247 123/41.54
(Continued)

FOREIGN PATENT DOCUMENTS

DE 4103523 A1 * 8/1992 ..... B60S 1/487
DE 10021180 A1 * 10/2001 ..... F01P 11/029
(Continued)

OTHER PUBLICATIONS

English machine Translation provided by Espacenet for DE 102017004632 A1 (Year: 2020).*
(Continued)

*Primary Examiner* — Jacob M Amick
*Assistant Examiner* — Michael A Kessler
(74) *Attorney, Agent, or Firm* — Quarles & Brady LLP

(57) ABSTRACT

A coolant reservoir tank includes a first compartment that is configured to receive and retain a first portion of a liquid coolant. The first compartment is configured to be in fluid communication with a first liquid cooling circuit. A second compartment is configured to receive and retain a second portion of the liquid coolant. The second compartment is configured to be in fluid communication with a second liquid cooling circuit. A dividing wall separates the first compartment from the second compartment. The coolant reservoir tank further includes a fill port.

20 Claims, 13 Drawing Sheets

(58) Field of Classification Search
USPC ..... 123/41.1
See application file for complete search history.

(56) References Cited

U.S. PATENT DOCUMENTS

| | | | | |
|---|---|---|---|---|
| 10,794,265 | B2 * | 10/2020 | Dumas | B01D 19/0042 |
| 2002/0157621 | A1 * | 10/2002 | Lefrancois | F01P 11/029 123/41.54 |
| 2006/0130778 | A1 * | 6/2006 | Pottie | F01P 7/165 123/41.1 |
| 2009/0159019 | A1 * | 6/2009 | Hutchins | F01P 11/029 123/41.01 |
| 2011/0210125 | A1 * | 9/2011 | Kardos | F01P 11/029 220/502 |
| 2011/0284107 | A1 | 11/2011 | Ciak et al. | |
| 2015/0345368 | A1 * | 12/2015 | Le Poul | F01P 11/029 123/41.51 |
| 2020/0009939 | A1 * | 9/2020 | Potticary | F01P 7/165 |
| 2020/0340389 | A1 * | 10/2020 | Dumas | F01P 11/029 |

FOREIGN PATENT DOCUMENTS

| | | | | | |
|---|---|---|---|---|---|
| DE | 102015015198 | A1 | | 5/2017 | |
| DE | 102017004632 | A1 | * | 11/2017 | F01P 11/029 |
| FR | 3016923 | A3 | * | 7/2015 | F01P 11/029 |
| JP | S54-141603 | U | | 10/1979 | |
| JP | 10266856 | A | * | 10/1998 | |
| WO | WO-03042516 | A2 | * | 5/2003 | F01P 11/029 |
| WO | 2010/059106 | A1 | | 5/2010 | |
| WO | 2014/111640 | A1 | | 7/2014 | |

OTHER PUBLICATIONS

English machine Translation provided by Espacenet for DE 10021180 A1 (Year: 2020).*

English machine Translation provided by Espacenet for FR 3016923 A3 (Year: 2020).*

International Search Report and Written Opinion from PCT Patent Application No. PCT/US2018/064099, dated Mar. 4, 2019.

* cited by examiner

COOLANT RESERVOIR TANK

RELATED APPLICATION

The present application claims the benefit of U.S. Provisional Application No. 62/594,570, filed on Dec. 5, 2017, and U.S. Provisional Application No. 62/599,898, filed on Dec. 18, 2017, both of which are incorporated herein by reference in their entirety.

BACKGROUND

Field of the Disclosure

Embodiments of the present disclosure generally relate to a coolant reservoir tank for a vehicle and, more particularly, to a coolant reservoir tank that is configured to provide liquid coolant to multiple components through multiple cooling circuits.

Description of the Background of Disclosure

Various motor vehicles, such as automobiles, trucks, buses, and the like, include components that generate heat during operation. A typical vehicle with an internal combustion engine (ICE) includes a cooling system that is configured to circulate liquid coolant through these components, e.g., a battery, an engine block, an inverter system circuit (ISC), and the like, to absorb the heat. The heat is carried through the liquid coolant and exchanged through another component, such as a radiator.

In one example, a vehicle with an ICE may include a single cooling circuit through which liquid coolant is circulated to cool multiple components. This single cooling circuit includes a single coolant reservoir tank retaining liquid coolant at a particular operating temperature.

However, other vehicles may employ multiple cooling circuits for more complex or higher capacity cooling systems, such as hybrid vehicles. In one example, a vehicle may have multiple separate and distinct cooling circuits operating at different temperatures to serve one or more distinct components. There, a first cooling circuit includes a first coolant reservoir tank that retains liquid coolant at a particular operating temperature that is delivered to and received from one or more components. Then, a second cooling circuit includes a second coolant reservoir tank that retains liquid coolant at another particular operating temperature that is delivered to and received from another one or more components. In this manner, each cooling circuit requires a single cooling reservoir tank for retaining the liquid coolant at a particular operating temperature. Accordingly, these vehicles may have two or more coolant reservoir tanks, each retaining liquid coolant at different operating temperatures.

However, space within a vehicle is limited. As can be appreciated, each coolant reservoir tank within a vehicle occupies space therein, which renders the space unavailable for other components. A need therefore exists for a compact coolant reservoir tank that may be disposed within a vehicle. Further, a need exists for a coolant reservoir tank that retains liquid coolant at different operating temperatures that is circulated through multiple cooling circuits to cool one or more components.

SUMMARY

In one aspect, a coolant reservoir tank comprises a first compartment that is configured to receive and retain a first portion of a liquid coolant. The first compartment is configured to be in fluid communication with a first cooling circuit. A second compartment is configured to receive and retain a second portion of the liquid coolant. The second compartment is configured to be in fluid communication with a second cooling circuit. A dividing wall separates the first compartment from the second compartment.

Further, the coolant reservoir tank includes a fill port.

In one embodiment, the dividing wall may be insulated to reduce heat transfer between the first portion and the second portion of the liquid coolant. The dividing wall may connect to a base and a cover of the coolant reservoir tank.

In another embodiment, the coolant reservoir tank also includes a fill port including a passage in fluid communication with the first compartment and the second compartment. The fill port is used to fill both the first compartment and the second compartment with the respective first portion and the second portion of the liquid coolant.

In at least one embodiment, the coolant reservoir tank includes a receiving chamber that connects to, or is otherwise in fluid communication with, a fill channel that fluidly connects to both the first compartment and the second compartment. The receiving chamber includes a fill bay with a lower ledge disposed at a maximum design fluid level of the coolant reservoir tank.

In a different embodiment, a fluid-separating rib is positioned underneath a fill port. The fluid-separating rib may be part of a cover of the coolant reservoir tank. The fluid-separating rib may be supported by the dividing wall. In some embodiments, the fluid-separating rib may be spaced apart from the dividing wall. The fluid-separating rib may include a central apex, a first receding side downwardly extending from the central apex, and a second receding side downwardly extending from the central apex.

In a further embodiment, a separating port is positioned between a fill port and the dividing wall. The separating port may include a first fluid opening fluidly connected to the first compartment, and a second fluid opening fluidly connected to the second compartment. The separating port may be selectively configurable to be in fluid communication with either the first compartment, the second compartment, or both the first and second compartments In still another embodiment, the dividing wall includes an opening formed at a lower portion. A channeling wall may be within one of the first compartment or the second compartment. The channeling wall may define a fluid passage that is in fluid communication with the opening.

In yet another embodiment, the coolant reservoir tank also includes a sump. The sump may include an internal barrier wall. One or more openings may fluidly connect the sump to the first compartment and the second compartment.

In another aspect, a coolant reservoir tank comprises a first compartment that is configured to receive and retain a first portion of a liquid coolant. The first compartment is configured to be in fluid communication with a first component. A second compartment is configured to receive and retain a second portion of the liquid coolant. The second compartment is configured to be in fluid communication with a second component. A dividing wall separates the first compartment from the second compartment, which includes an opening formed at a lower portion thereof. Further, a fill port is provided. Still further, a separating port is positioned between the fill port and the dividing wall, which includes a first fluid opening to the first compartment and a second fluid opening to the second compartment.

In still another aspect, a liquid cooling circuit system for a vehicle comprises a first circuit having one or more components, wherein one of the components is a battery. The liquid cooling system also includes a second circuit having one or more components, wherein one of the components is an inverter system circuit. A coolant reservoir tank for retaining and circulating liquid coolant in relation to the first circuit and the second circuit is provided, which comprises a first compartment, a second compartment, a dividing wall, and a fill port. The first compartment is configured to receive and retain a first portion of a liquid coolant, wherein the first compartment is configured to be in fluid communication with the battery. The second compartment is configured to receive and retain a second portion of the liquid coolant, wherein the second compartment is configured to be in fluid communication with the inverter system circuit. The dividing wall separates the first compartment from the second compartment and the fill port is in fluid communication with the first compartment and the second compartment.

DETAILED DESCRIPTION

Embodiments of the present disclosure provide a coolant reservoir tank that includes multiple compartments that retain liquid coolant therein. The coolant reservoir tank may include a single fill point that is used to fill the compartments. Each compartment is in fluid communication with a separate and distinct cooling circuit that couples to one or more components. As such, isolated compartments within the coolant reservoir tank are provided within a single coolant reservoir tank that is in fluid communication with multiple cooling circuits. The compartments may be thermally insulated, such that heat transfer between fluids in the compartments is minimized or otherwise reduced.

Figure 1:
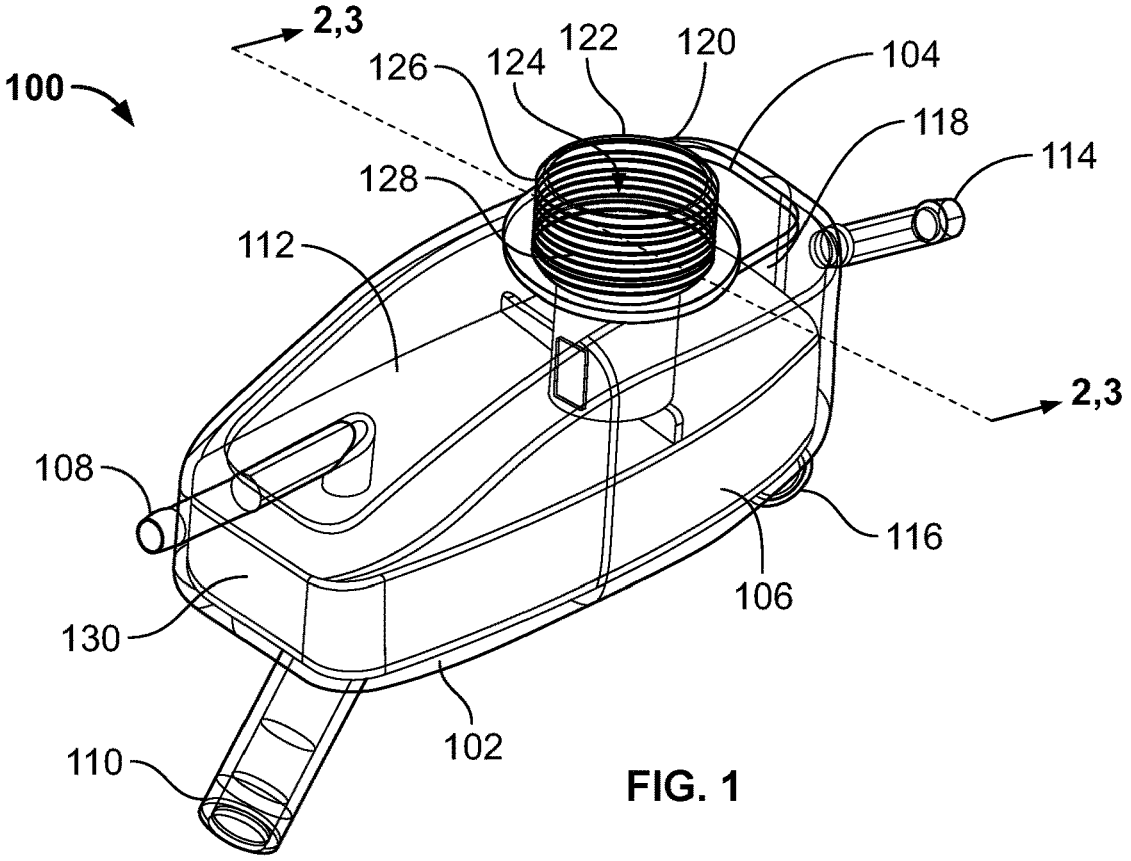
FIG. 1 is a perspective view of a front, top, and left side of a coolant reservoir tank, with portions shown in transparency for purposes of clarity to show internal portions thereof.

FIG. 1 illustrates a coolant reservoir tank 100, according to one embodiment of the present disclosure. The coolant reservoir tank 100 is configured to be disposed within an engine bay of a vehicle (not shown). The coolant reservoir tank 100 provides a housing that includes a base 102 connected to a top wall or cover 104 through upstanding walls 106. The base 102, the cover 104, and the upstanding walls 106 may be formed of a plastic, for example. In at least one embodiment, the base 102, the cover 104, and the walls 106 are integrally molded and formed as a single housing. In a different embodiment, the cover 104 may be separately formed and secured over and onto the walls 106, such as through welding, adhesives, fasteners, and/or the like.

With continued reference to FIG. 1, a first inlet line 108 and a first outlet line 110 are in fluid communication with a first compartment 112 and a first circuit including one or more components. Similarly, a second inlet line 114 and a second outlet line 116 are in fluid communication with a second compartment 118 and a second circuit including one or more components. A fill port 120 extends into the cover 104. The fill port 120 includes a tubular fitting 122 that defines a central passage 124. An outer surface 126 of the fitting 122 includes threads 128 that are configured to be threadably retained to corresponding threads on an inner surface of a cap (not shown), which is configured to removably connect to the fitting 122. In order to fill the coolant reservoir tank 100, liquid coolant 130 is poured through the central passage 124 of the fill port 120. It is contemplated that in some embodiments, only a single fill port is provided that is in fluid communication with two or more compartments of a coolant reservoir tank.

The first compartment 112 is part of a first liquid circuit or loop that connects to one or more components, such as an ISC, while the second compartment 118 is part of a second liquid circuit or loop that connects to another one or more components, such as a battery. It should be stated that the ISC and the battery are merely examples of components within a vehicle coupled to a cooling circuit serving one or more such components. In fact, it is intended that the present disclosure be used with any components in, or otherwise in functional communication with, cooling circuits within a vehicle or other device. In one specific implementation, the first compartment 112 is fluidly connected to a first inlet line and a first outlet line (e.g., 108, 110) that fluidly connect to the first liquid circuit, and the second compartment 118 is fluidly connected to a second inlet line and a second outlet line (e.g., 114, 116) that fluidly connect to the second liquid circuit.

Figure 2:
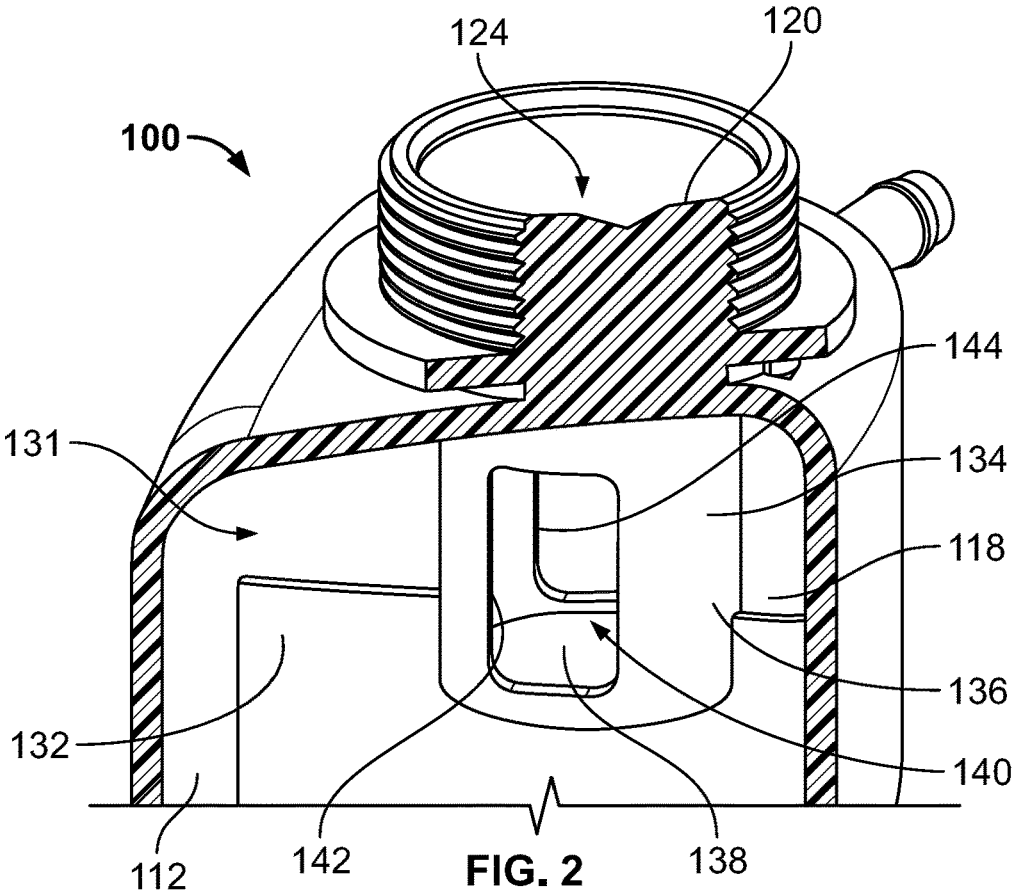
FIG. 2 is a cross-sectional view of a portion of the coolant reservoir tank of FIG. 1 taken along line 2-2 of FIG. 1.
Figure 3:
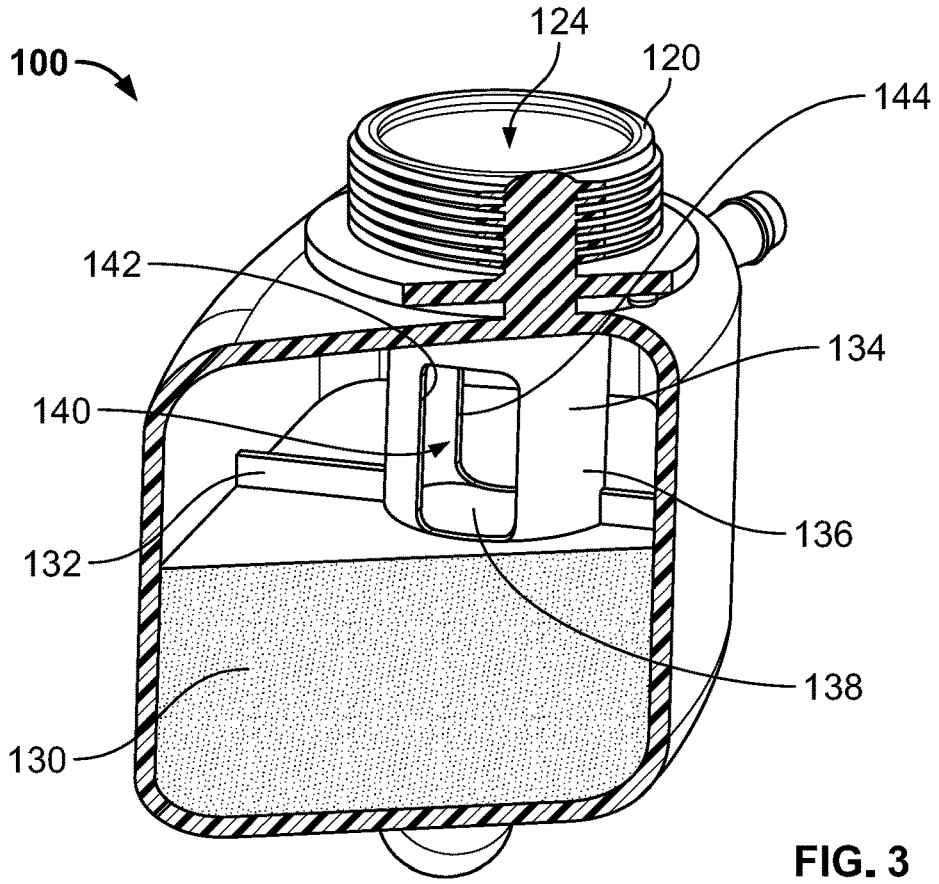
FIG. 3 is a cross-sectional view of the coolant reservoir tank of FIG. 1 taken along line 3-3 of FIG. 1.

Now referring to FIGS. 2 and 3, an internal retaining chamber 131 is defined between the base 102, the cover 104, and the walls 106. The internal retaining chamber 131 is separated into the first compartment 112 (such as a first fluid retaining cell, chamber, volume, and/or the like) and the second compartment 118 (such as a second fluid retaining cell, chamber, volume, and/or the like). The first compartment 112 is separated from the second compartment 118 by a dividing wall 132, which prevents the liquid coolant 130 from comingling. In this manner, the first compartment 112 and the second compartment 118 may be filled simultaneously from the single fill port 120. Further, each of the cooling circuits remains separate and distinct from each other.

In some aspects, the dividing wall 132 may be thermally insulated to minimize heat transfer between or among the first and second compartments 112, 118. In the present embodiment, the first compartment 112 and the second compartment 118 are of equal volume. The first compartment 112 and the second compartment 118 may define different volumes in other embodiments.

With continued reference to FIGS. 2 and 3, the fill port 120 connects to a separating port 134 positioned between the fill port 120 and the dividing wall 132. The fill port 120 and the separating port 134 may be located over any portion of the dividing wall 132. In at least one alternative embodiment, the dividing wall 132 may extend an entire height of the internal chamber 131, to fully separate the compartments 112, 118. The separating port 134 includes wall(s) 136 enclosing a space that in the present embodiment is cylindrical or tubular. The tubular wall 136 connects to a lower ledge 138 that is positioned over the dividing wall 132. A fluid passage 140 is defined between the tubular wall 136 and the ledge 138. The fluid passage 140 fluidly connects to the central passage 124 of the fill port 120. The ledge 138 may be located at a height that coincides with a maximum fluid level within the coolant reservoir tank 100, which minimizes or otherwise reduces fluid communication between the first and second compartments 112, 118, and provides for an easier filling method.

A first fluid opening 142 is formed on one side of the separating port 134, while a second fluid opening 144 is formed on an opposite side of the separating port 134. The first fluid opening 142 fluidly connects to the first compartment 112, while the second fluid opening 144 fluidly connects to the second compartment 118. As such, liquid coolant 130 that passes into the fluid passage 140 of the separating port 134 passes into the first and second compartments 112, 118 via the first fluid opening 142 and the second fluid opening 144, respectively. As such, the liquid coolant 130 may be characterized as having a first portion in the first compartment 112 and a second portion in the second compartment 118. In this manner, both the first compartment 112 and second compartment 118 may be filled with liquid coolant 130 simultaneously through the fill port 120.

Additionally or alternatively, the separating port 134 may further include a tubular sleeve (not shown) that is concentrically positioned within the tubular wall 136 and includes a single fluid opening having similar dimensions as the first or second fluid opening, 142, 144. The tubular sleeve may be selectively rotated by a user to align the single fluid opening with either the first or second fluid opening 142, 144, thereby allowing a user to fill either the first compartment 112 or the second compartment 118 individually. The tubular sleeve may be configured to be removable, or to have a projection, similar to a handle, capable of facilitating manipulation by a user. As such, the tubular sleeve may permit a user to fill the first chamber 112 before the second chamber 118, or to fill the first chamber 112 with a particular type of liquid coolant 130 and the second chamber 118 with a different variant of liquid coolant 130.

It is also contemplated that the tubular sleeve of the present embodiment could include two or more fluid openings that may be aligned with a corresponding number of openings in a separating port. For example, if a separating port included two openings in communication with different compartments, the tubular sleeve may be rotatable into fluid alignment with only one of the openings in the separating port, none of the openings in the separating port, or both of the openings in the separating port.

Figure 4:
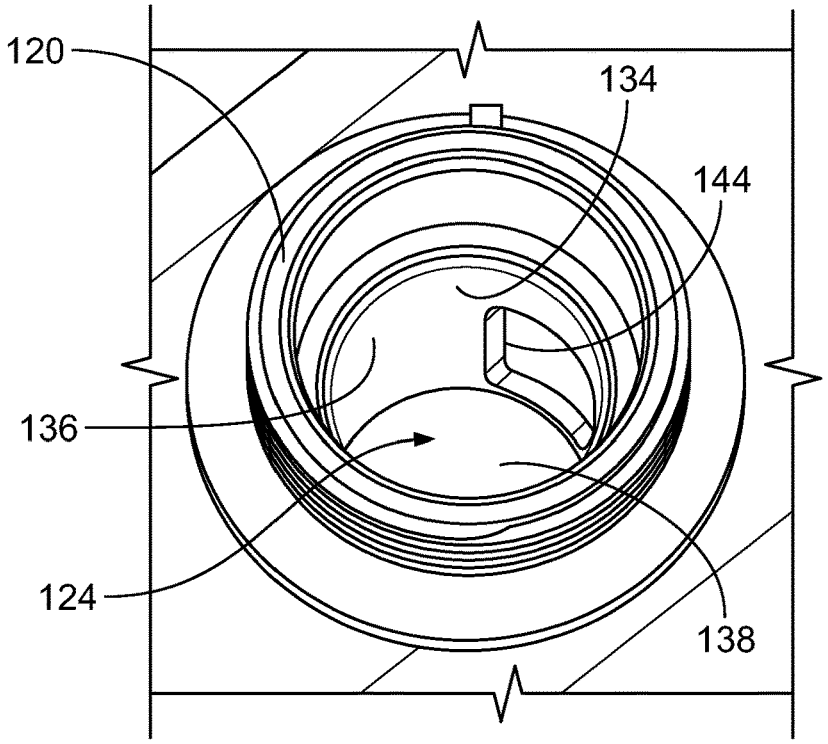
FIG. 4 is a fragmentary view of a top, side, and internal side of a fill port of a coolant reservoir tank.

Now referring to FIG. 4, the separating port 134 can be seen extending below the central passage 124 of the fill port 120. The second fluid opening 144 is formed in the tubular wall 136 above the lower ledge 138 and beneath the central passage 124.

Figure 5:
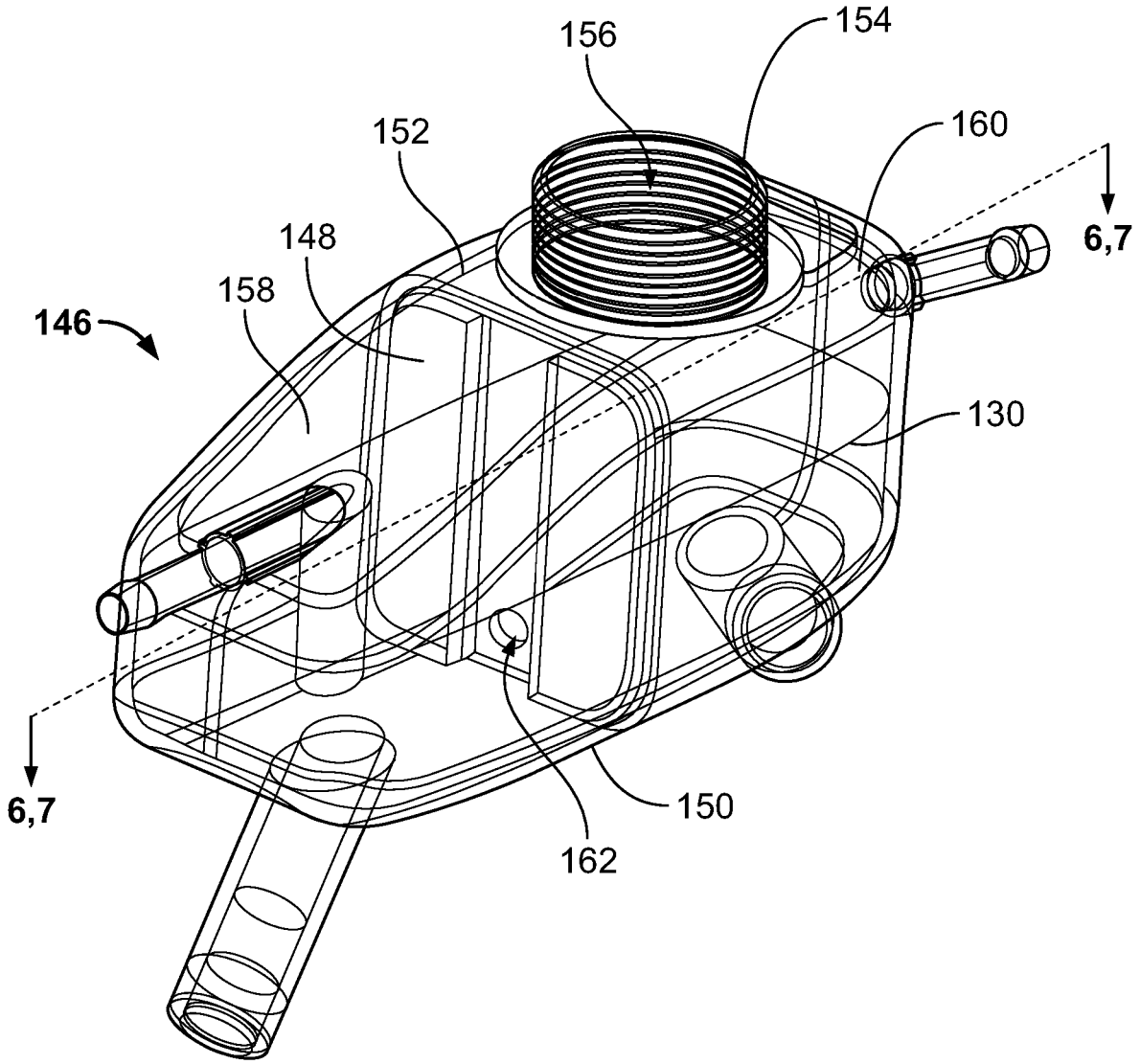
FIG. 5 is a perspective view of a front, top, and left side of another embodiment of a coolant reservoir, wherein portions are shown in transparency to show internal portions thereof.
Figure 6:
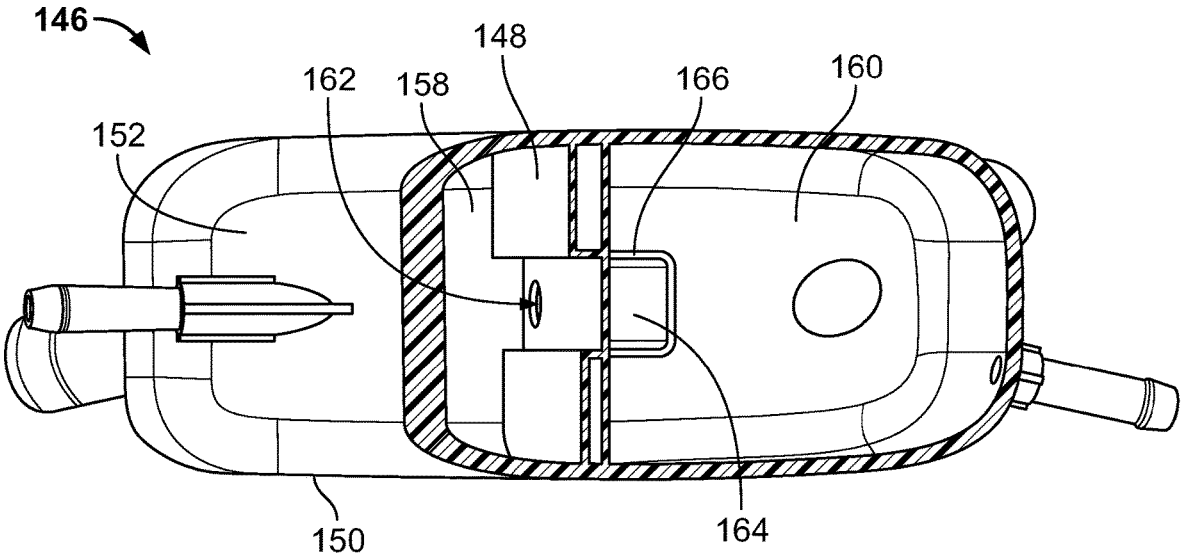
FIG. 6 is a top plan view of the coolant reservoir tank of FIG. 5, showing a fragmentary sectional view taken along the line 6-6 of FIG. 5.
Figure 7:
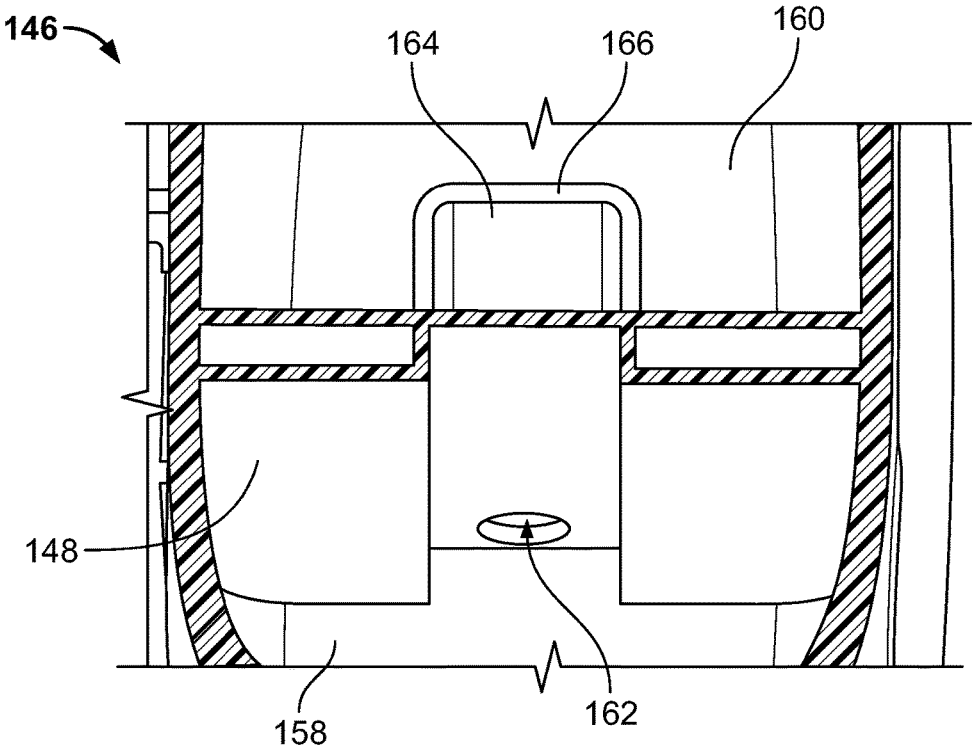
FIG. 7 is a perspective view of a top and left side of a portion of a dividing wall of the coolant reservoir tank of FIG. 6.

Referring to FIG. 5, according to another embodiment of a coolant reservoir tank 146, a dividing wall 148 may extend from an upper surface of a base 150 to a lower surface of a top wall or cover 152. The cover 152 includes a fill port 154 having a downwardly extending central passage 156, which is in fluid communication with a first compartment 158 and a second compartment 160. An opening 162 may be formed through a lower portion of the dividing wall 148. As shown in FIGS. 6 and 7, the opening 162 fluidly connects to a fluid passage 164 formed by a channeling wall 166 within the second compartment 160. The channeling wall 166 extends upwardly from the opening 162 toward the cover 152. The channeling wall 166 may angle downwardly from an open upper receiving end toward the opening 162. In this manner, the channeling wall 166 is configured to receive liquid coolant 130 within the fluid passage 164 and channel the liquid coolant 130 toward and into the opening 162.

It is contemplated that the channeling wall 166 may be located underneath or proximate to the fill port 154 (shown in FIGS. 5 and 6), which may be located above the second compartment 160. In other embodiments, the channeling wall 166 may be located within the first compartment 158, and the fill port 154 may be located above the first compartment 158.

In order to fill the first and second compartments 158, 160 with the liquid coolant 130, the liquid coolant 130 passes into the second compartment 160 through the fill port 154. The liquid coolant 130 may first fill the second compartment 160. As the liquid coolant 130 reaches the height of an upper edge of the channeling wall 166, a portion of the liquid coolant 130 spills into the fluid passage 164 and passes into the first compartment 158 via the opening 162, until both the first and second compartments 158, 160 are filled to a desired level. In some embodiments, if the channeling wall 166 is positioned directly underneath the fill port 154, the first compartment 158 may be filled first, and liquid coolant 130 may then spill over the upper edge of the channeling wall 166 into the second compartment 160.

It is contemplated that the opening 162 may be sized and shaped differently than shown. In at least one embodiment, the channeling wall 166 may be angled in order to retain liquid coolant 130 thereon or therein.

Figure 8:
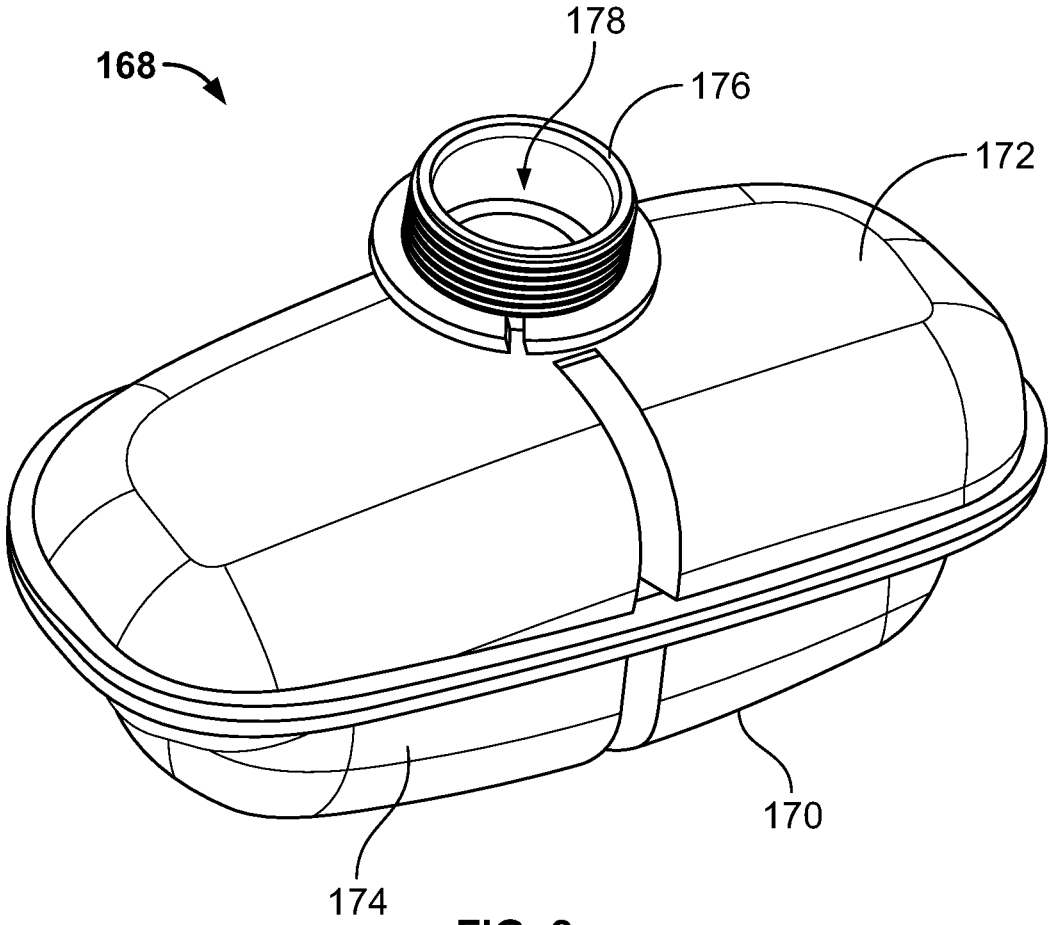
FIG. 8 is a perspective view of a front, top, and left side of yet another embodiment of a coolant reservoir tank.
Figure 9:
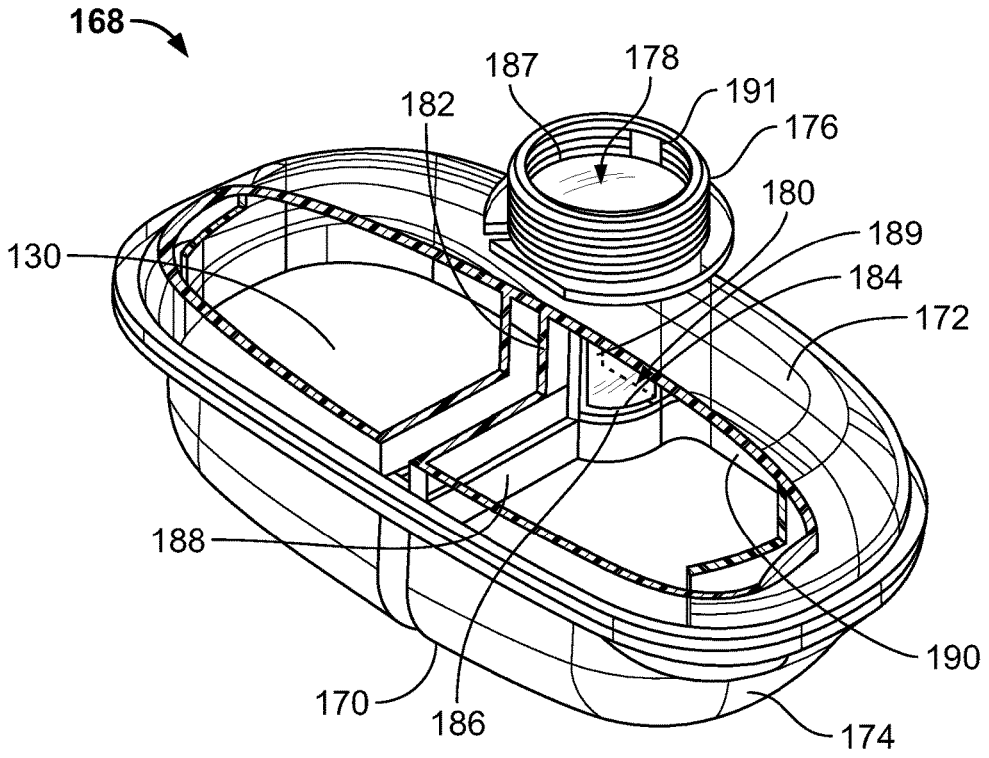
FIG. 9 illustrates a perspective view of a front, top, and right side of the coolant reservoir tank of FIG. 8, further showing internal portions thereof.

With reference to FIGS. 8 and 9, another embodiment of a coolant reservoir tank 168 is depicted having a base 170, a top wall or cover 172, and walls 174. The cover 172 includes a fill port 176 having a central passage 178 extending below the inside surface of the cover 172.

Figure 10:
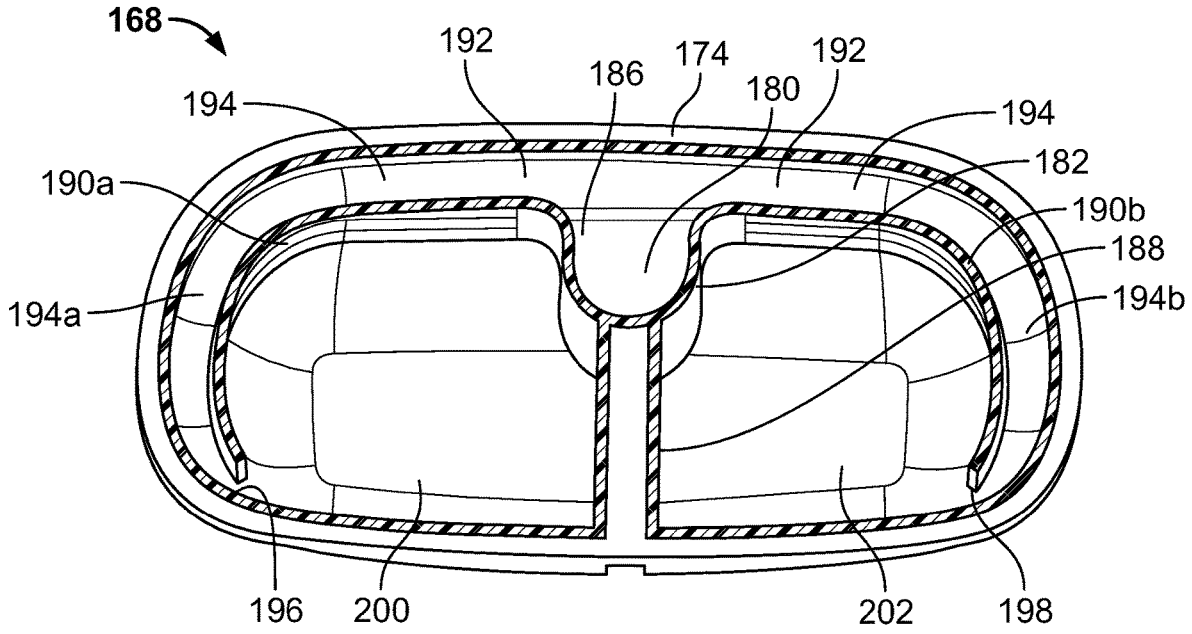
FIG. 10 illustrates a top plan view of the base portion of the coolant reservoir tank of FIG. 8.

As shown in FIG. 9, the central passage 178 connects to a receiving chamber 180 defined between an internal central wall 182 and an upper surface of a lower ledge 184. A fill bay 186 is formed below the receiving chamber 180 and is defined by the internal central wall 182 and the horizontal surface of the lower ledge 184 that is coplanar with a top of a dividing wall 188. The fill bay 186 connects to internal walls 190 that conform to a curvature of walls 174. Referring to FIG. 10, the internal walls 190 include a first wall 190*a* and a second wall 190*b* that is disposed opposite the first wall 190*a* relative to the internal central wall 182. The central passage 178 of the fill port 176 is in fluid communication with the receiving chamber 180 and the fill bay 186.

Still referring to FIG. 9, the lower ledge 184 of the fill bay 186 may be at a height of a maximum designed fluid level of the coolant reservoir tank 168. In this manner, a filling device (such as a filling gun) that is used to fill the coolant reservoir tank 168 may remove liquid so that the liquid coolant 130 within the coolant reservoir tank 168 is at an intended level as the filling device is drawn back from pressure filling.

With reference to FIG. 10, fluid passages 192 are formed in either side, or opposing ends, of the internal central wall 182. The fluid passages 192 define portions of a fill channel 194 extending along the internal walls 190, such as a first channel 194*a* and a second channel 194*b*. The fill channel 194 extends laterally in a direction that is perpendicular to a vertical direction of the central passage 178 of the fill port 176, and further includes a first outlet passage 196 and a second outlet passage 198 that is spaced apart from and disposed opposite to the first outlet passage 196 relative to the fill bay 186 and the internal central wall 182. The first outlet passage 196 curves inward from the first channel 194*a* relative to the fill bay 186 and leads into a first compartment 200, while the second outlet passage 198 curves inward from the second channel 194*b* relative the fill bay 186 and leads into a second compartment 202. As such, the first outlet passage 196 and the second outlet passage 198 are curved toward each other. The first channel 194*a* extends laterally from the fill bay 186 between the wall 174 and the first wall 190*a* that separates the first compartment 200 from the first channel 194*a*. The second channel 194*b* extends laterally from the fill bay 186 between the wall 174 and the second wall 190*b* that separates the second channel 194*b* from the second compartment 202. The internal walls 190 extend substantially parallel with the wall 174 and maintain a distance from the wall 174, as depicted in FIG. 10. As such, the first channel 194*a* may direct the liquid coolant 130 in an opposite direction relative to the fill bay 186 than the second channel 194*b*, or in the same direction relative to the fill bay 186. Further, the first channel 194*a* is fluidly connected to the fill port 176, the fill bay 186, and the first compartment 200, and the second channel 194*b* is fluidly connected to the fill port 176, the fill bay 186, and the second compartment 202. Accordingly, after liquid coolant 130 is poured into the fill port 176 it then passes into the receiving chamber 180, over the lower ledge 184 of the fill bay 186, and into the fill channel 194 through both fluid passages 192. From there, the liquid coolant 130 then flows into both the first and second compartments 200, 202 through the first and second fluid outlet passages 196, 198, respectively. In some examples, the first compartment 200 and the second compartment 202 may define different volumes and, therefore, receive different volumes of the liquid coolant 130. For example, the first compartment 200 may become filled above a maximum designed fluid level by the liquid coolant 130 prior to the second compartment 202 becoming filled. In such an example, the liquid coolant 130 may flow from the first compartment 200 to the second compartment 202 through the first channel 194*a*, the fill channel 194, and the second channel 194*b*. In other examples, the second compartment 202 may become filled above a maximum designed fluid level by the liquid coolant 130 prior to the first compartment 200 becoming filled and, therefore, the liquid coolant 130 may flow from the second compartment 202 to the first compartment 200 through the second channel 194*b*, the fill channel 194, and the first channel 194*a*. It is contemplated that the fill channel 194 may be inclined, angled, or otherwise disposed between the fill bay 186 and the first and second outlet passages 196, 198. For example, the fill channel 194 may decline from the fill bay 186 to the first and second outlet passages 196, 198 in order to promote efficient and consistent drainage (such as via gravity) of the liquid coolant 130 into the first and second compartments 200, 202. Additionally or alternatively, the coolant reservoir tank 168 may further include a tubular sleeve 187 that is concentrically positioned within the central passage 178 along the internal central wall 182 and includes a fluid opening 189, as depicted in FIG. 9. The tubular sleeve 187 may be selectively rotated by a user to align the single fluid opening 189 opening with either the first fluid passage 194*a* or the second channel 194*b*, thereby allowing a user to fill either the first compartment 200 or the second compartment 202 individually. The tubular sleeve 187 may be configured to be removable, or to have a projection 191, similar to a handle, capable of facilitating manipulation by a user. As such, the tubular sleeve 187 may permit a user to fill the first compartment 200 before the second compartment 118, or to fill the first compartment 200 with a particular type of liquid coolant 130 and the second chamber 202 with a different variant of liquid coolant 130. It is also contemplated that the tubular sleeve 187 of the present embodiment could include additional fluid openings 189 that may be aligned with a corresponding number of fluid passages or compartments. For example, if the fill bay 186 included two openings in communication with different compartments, the tubular sleeve 187 may be rotatable into fluid alignment with only one of the openings, none of the openings, or both of the openings in the fill bay 186.

Additionally, the fill port 176 and the fill bay 186 may be located proximate to a portion of the walls 174, and generally aligned with the dividing wall 188. In some embodiments, the fill port 176 and/or the fill bay 186 may be located at various other locations, such as at a center of the coolant reservoir tank 168, over one of the first or second compartments 200, 202, and/or the like.

In operation, the liquid coolant 130 within each of the first and second compartments 200, 202 is circulated in relation to first and second liquid circuits, having first and second inlet and outlet lines (not shown) extending therefrom. Liquid coolant 130 within the first compartment 200 is dedicated to the first liquid circuit, while liquid coolant 130 within the second compartment 202 is dedicated to the second liquid circuit. Accordingly, the single coolant reservoir tank 168 is used to supply liquid coolant 130 to two different cooling circuits in a parallel manner. Liquid coolant 130 within the separate first and second compartments 200, 202 is separated by the dividing wall 188 to prevent, limit, or otherwise reduce unintended comingling among the first and second compartments 200, 202. Further, the dividing wall 188, the outer wall 174, the base 170, and/or the cover 172 may be insulated to limit or otherwise reduce heat transfer between the first and second compartments 200, 202.

Figure 11:
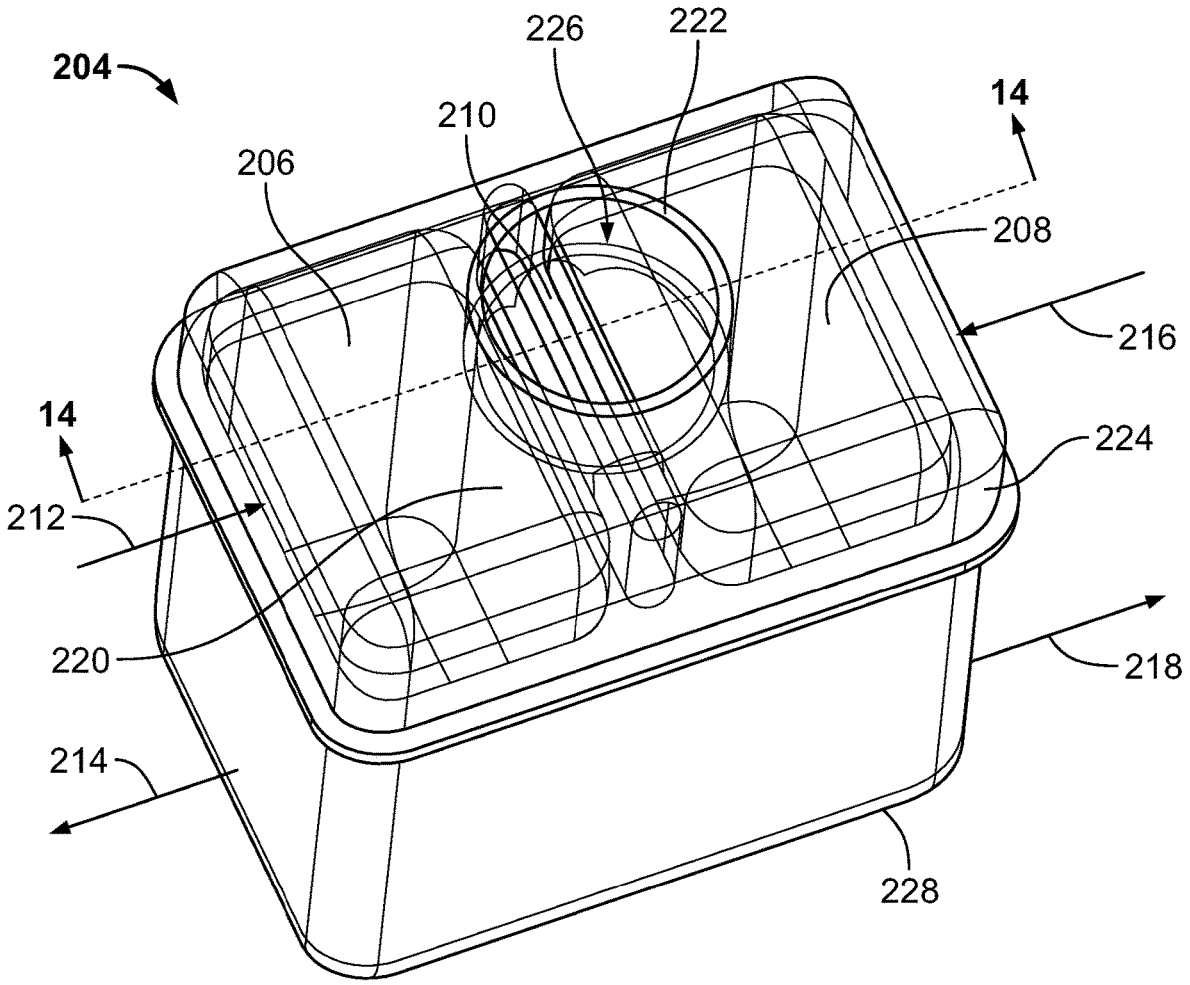
FIG. 11 is a perspective view of a top, front, and left side of another embodiment of a coolant reservoir tank, with portions shown in transparency to show internal portions thereof.

FIG. 11 illustrates another embodiment of a coolant reservoir tank 204. The coolant reservoir tank 204 includes first and second compartments 206, 208 separated by a fluid-separating rib 210. The first compartment 206 is in fluid communication with a first inlet line 212 and a first outlet line 214 that are also in fluid communication with a first liquid circuit. The second compartment 208 is in fluid communication with a second inlet line 216 and a second outlet line 218 that are in fluid communication with a second liquid circuit. The fluid-separating rib 210 is supported over a dividing wall 220. In at least one other embodiment, the fluid-separating rib 210 may be an upper portion of the dividing wall 220.

Figure 12:
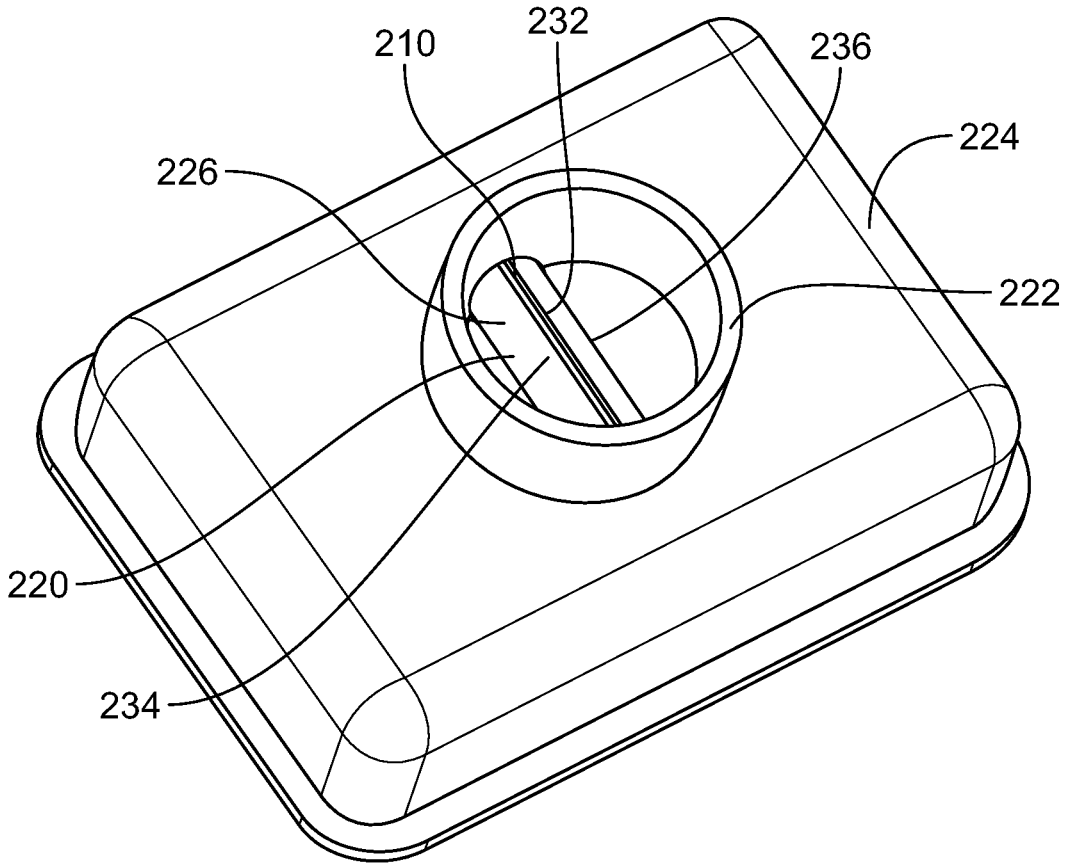
FIG. 12 is a perspective view of a front, top and left side of a cover of the coolant reservoir tank of FIG. 11.

As depicted in FIGS. 11 and 12, a fill port 222 may be located over a central portion of a cover 224. A central passage 226 of the fill port 222 is provided directly over a central portion of the fluid-separating rib 210. In some embodiments, the fill port 222 may be located in other areas of the cover 224 either directly over the fluid-separating rib 210, or offset therefrom.

Figure 13:
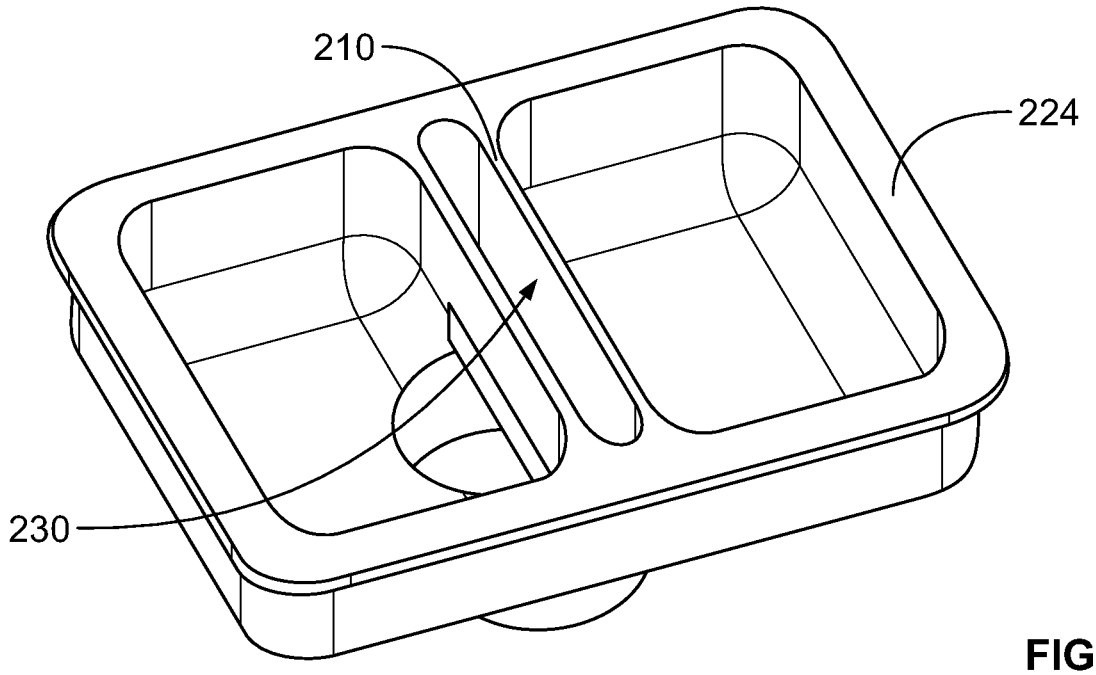
FIG. 13 is a perspective view of a rear, bottom, and right side of the cover of FIG. 11.

With reference to FIG. 12, the fluid-separating rib 210 is part of the cover 224. In other embodiments, the fluid-separating rib 210 may extend upwardly from a dividing wall that extends from an upper surface of a base 228 (see FIGS. 11 and 14). The fluid-separating rib 210 forms a splitting wall that allows liquid coolant 130 to drain downwardly over either side. In one embodiment, a recess 230 (shown in FIG. 13) may be disposed within the fluid separating rib 210 to form a gap between the fluid separating rib 210 and the dividing wall 220. Air may transfer through the gap between the first and second compartments 206, 208 to maintain a uniform air pressure within the coolant reservoir tank 204.

Figure 14:
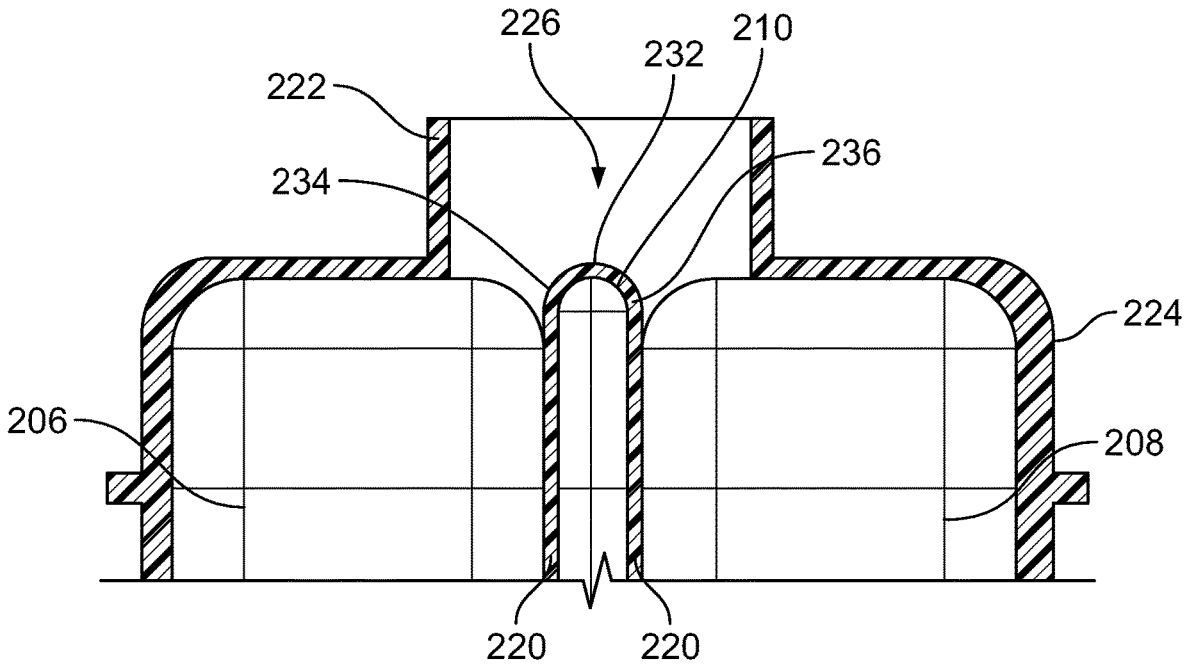
FIG. 14 is a partial cross-sectional view of the coolant reservoir tank of FIG. 11 taken along the line 14-14 of FIG. 11.

Referring now to FIGS. 12 and 14, the fluid-separating rib 210 may include a central apex 232 and receding sides 234, 236 that downwardly curve and/or angle from the apex 232. As such, liquid coolant 130 poured through the fill port 222 of the cover 224 drains downwardly over the sides 234, 236 and into the first and second compartments 206, 208, respectively. The apex 232 may extend into the central passage 226 of the fill port 222, thereby ensuring that liquid coolant 130 within the separate compartments 206, 208 does not comingle.

Figure 15:
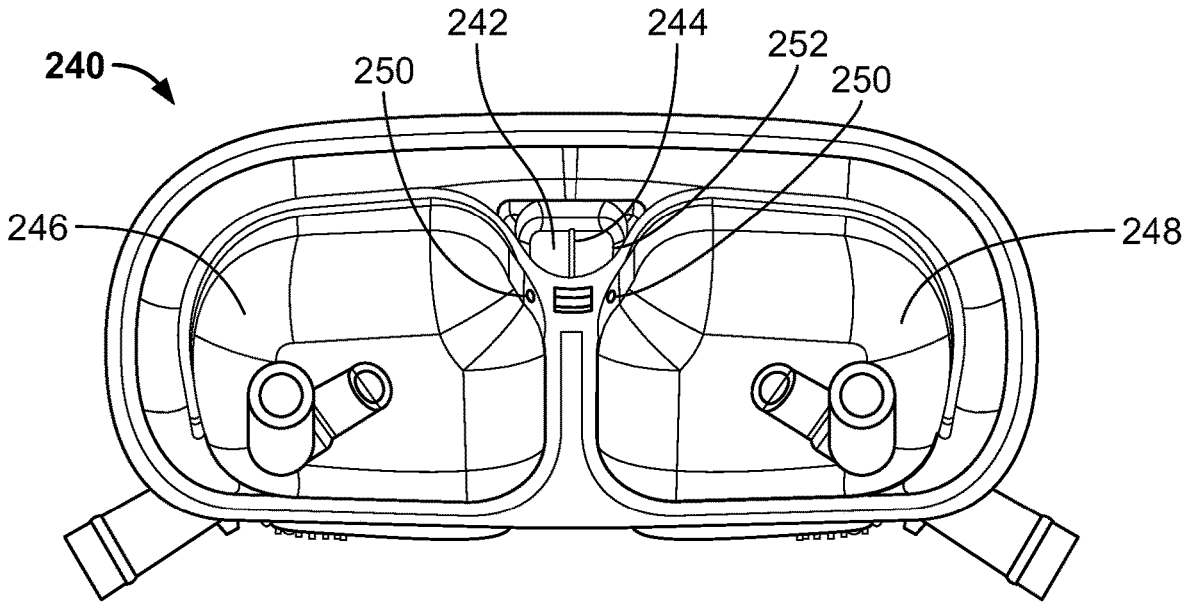
FIG. 15 is top plan view of a lower section of still another embodiment of a coolant reservoir tank.
Figure 16:
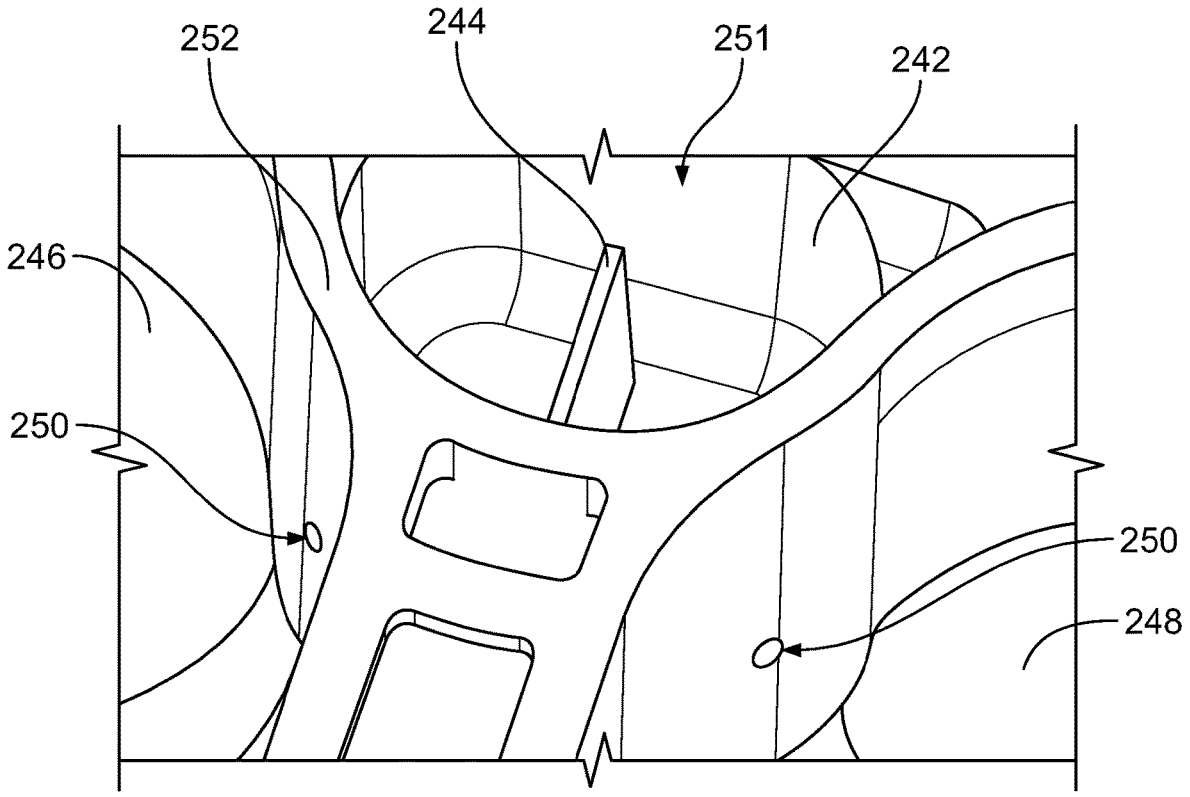
FIG. 16 is a perspective view of a portion of the lower section of the coolant reservoir tank of FIG. 15.
Figure 17:
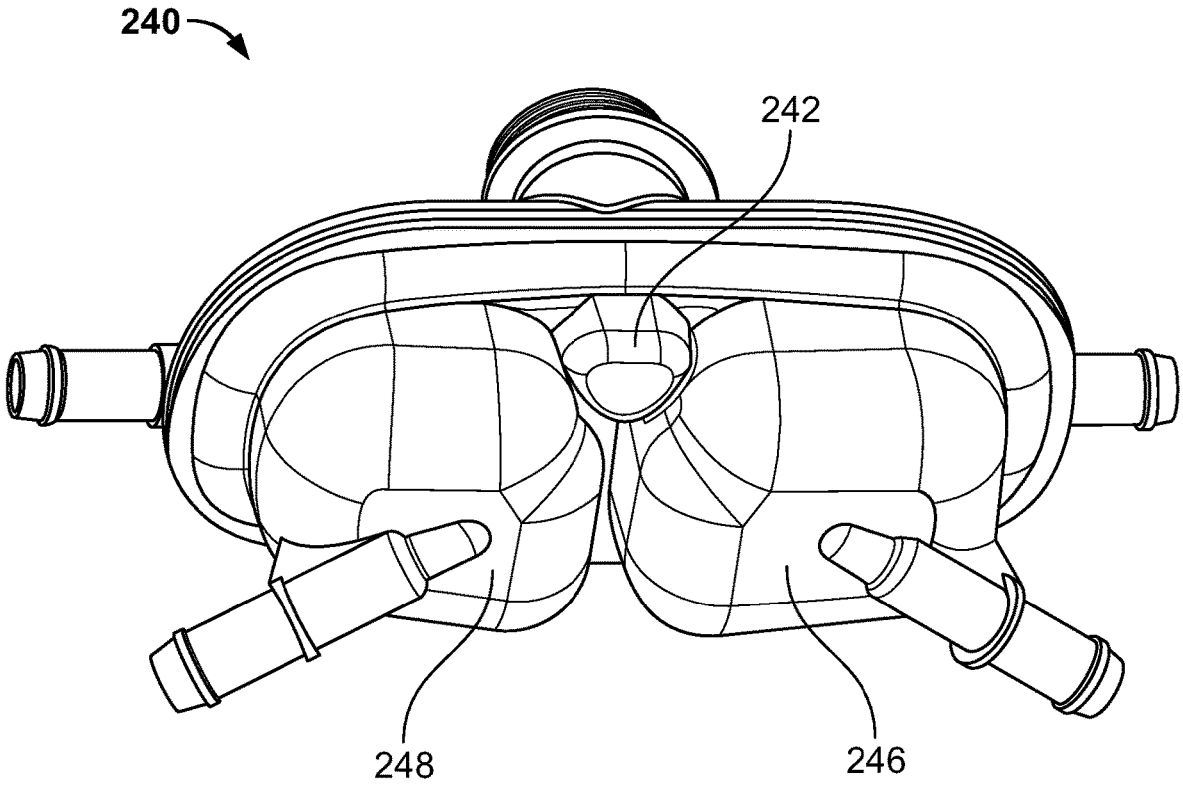
FIG. 17 is a perspective view of a bottom and rear of the coolant reservoir tank of FIG. 15.

Referring to FIGS. 15-17, according to another embodiment the coolant reservoir tank 240 includes a sump 242. The sump 242 is positioned at a level below a predetermined normal level of liquid within the coolant reservoir tank 240. A barrier wall 244 (shown in FIGS. 15 and 16) may be disposed within the sump 240, which is positioned between a first compartment 246 and a second compartment 248. The barrier wall 244 is configured to slow liquid interchange between the two compartments 246 and 248. In some embodiments, the sump 242 may be positioned within one of the first or second compartments 246, 248, or otherwise offset from one of the compartments 246, 248.

As shown in FIGS. 15 and 16, openings 250 (such as holes) may be formed through an internal boundary wall 252 of the sump 242. The openings 250 fluidly connect an internal retaining chamber 251 of the sump 242 to the first and second compartments 246, 248. The openings 250 are configured to allow for fluid leveling such that the liquid coolant 130 may be retained at substantially the same volume in each of the first and second compartments 246, 248. The openings 250 may be various sizes and shapes to impact the rate of fluid leveling. In at least one embodiment, two or more openings 250 may fluidly connect the first and second compartments 246, 248 to the sump 242. An upper portion of the barrier wall 244 may be angled or otherwise inclined to further slow the rate of fluid exchange or limit the exchange in one or more liquid inclination states. Additionally, the sump 250 may be present within any of the coolant reservoir tank embodiments of FIGS. 1-18, including a coolant reservoir tank having a separating port, a channeling wall, or a fluid separating rib.

Now referring to FIGS. 1-17, the coolant reservoir tank embodiments include first and second compartments. In some embodiments, the coolant reservoir tanks may include additional compartments. For example, a coolant reservoir tank may include three separate compartments, or four separate compartments, or even five separate compartments separated by dividing walls. As such, a coolant reservoir tank may have more than one sump. Alternatively, a coolant reservoir may have a single sump in fluid communication with each of the two, or three, or four, or five compartments. Additionally, each compartment may be configured to receive particular types of liquid coolant 130 having different chemical properties, such as liquid coolants 130 suitable for use with higher temperatures or use in colder climates. In this manner, liquid coolant 130 may be retained at different temperatures inside the single coolant reservoir tank.

Figure 18:
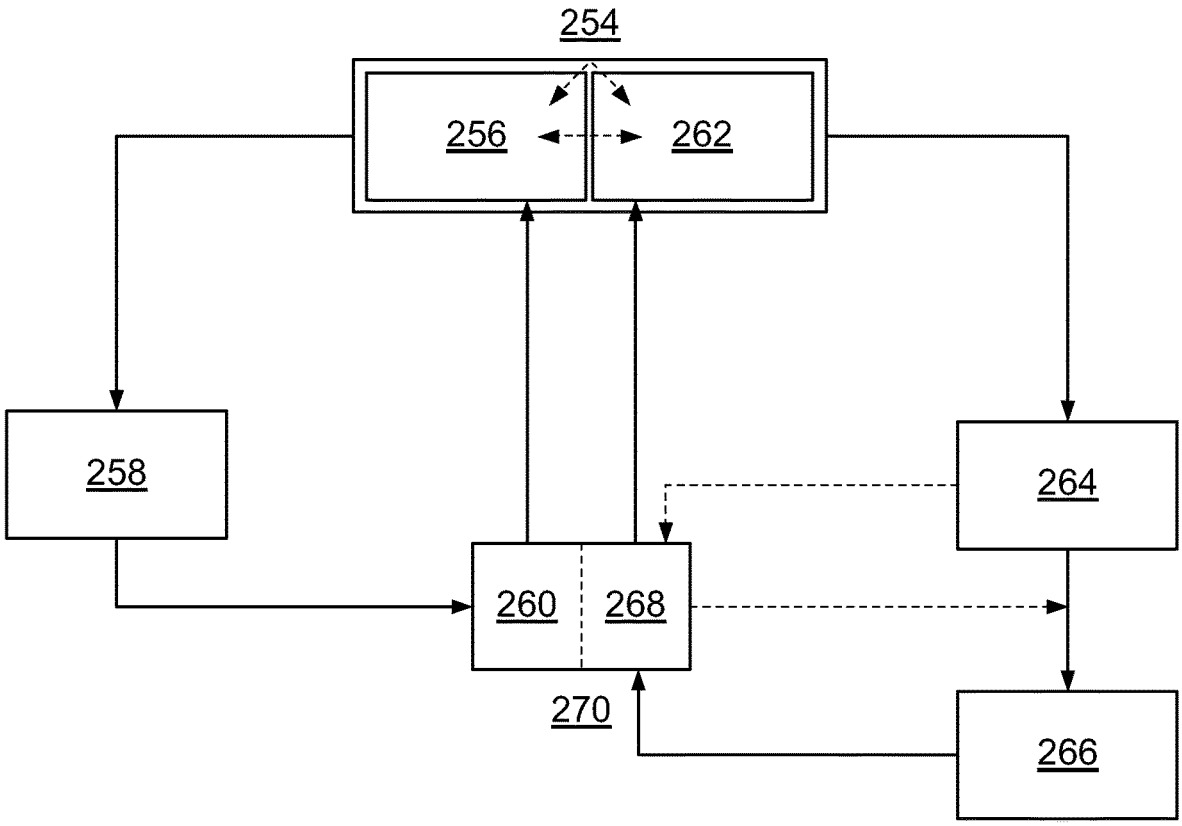
FIG. 18 is a schematic representation of a coolant reservoir tank having two internal compartments fluidly connected to liquid cooling circuits.

As will be appreciated from the schematic representation depicted in FIG. 18, a vehicle may have two distinct liquid cooling circuits coupled to a coolant reservoir tank 254. A first liquid cooling circuit includes a first compartment 256 disposed within the coolant reservoir tank 254 and fluidly connected with a first component 258 and a heat exchanger 260. The liquid coolant 130 retained in the first compartment 256 is circulated through the first component 258, absorbing the heat generated therefrom. The liquid coolant 130 carries the heat absorbed to the first heat exchanger 260 where it is transferred out of the first liquid cooling circuit.

Still with reference to FIG. 18, a second liquid cooling circuit includes a second compartment 262 disposed within the coolant reservoir tank 254 and fluidly connected with a second component 264, a third component 266, and a second heat exchanger 268. The liquid coolant 130 retained in the second compartment 262 is circulated through the second component 264, absorbing the heat generated therefrom. Then, liquid coolant 130 is circulated through the third component 266, absorbing the heat generated therefrom. Finally, the liquid coolant 130 carries the heat absorbed to the second heat exchanger 268 where it is transferred out of the second liquid cooling circuit. Optionally, the liquid coolant 130 may carry the heat absorbed from the second component 264 to the second heat exchanger, where such heat may be transferred out of the second liquid circuit prior to the liquid coolant being circulated to the third component 266. In this manner, the liquid coolant 130 may enter the third component 266 at a lower temperature. In some aspects, the first and second heat exchangers 260, 268 may be intertwined or split within a single high capacity heat exchanger 270.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings.

All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

The invention claimed is:

1. A coolant reservoir tank, comprising:

a single fill port;

a first compartment configured to receive and retain a first portion of a liquid coolant received through the fill port, wherein the first compartment is configured to be in fluid communication with a first liquid cooling circuit; and a second compartment configured to receive and retain a second portion of the liquid coolant received through the fill port, wherein the second compartment is configured to be in fluid communication with a second liquid cooling circuit; and a dividing wall separating the first compartment from the second compartment, wherein an exterior wall extends from the fill port, wherein a first channel is defined between the exterior wall and a first interior wall, the first channel being fluidly connected to the fill port and the first compartment, wherein a second channel is defined between the exterior wall and a second interior wall, the second channel being fluidly connected to the fill port and the second compartment, and wherein a first outlet passage is spaced apart from the dividing wall.

2. The coolant reservoir tank of claim 1 further comprising a fill bay that extends from the fill port and a fill channel that extends from the fill bay and between the first channel and the second channel.

3. The coolant reservoir tank of claim 1, wherein the first interior wall extends parallel with and at a distance from the exterior wall, the second interior wall extends parallel with and at a distance from the exterior wall, and the first interior wall and the second interior wall each follow a curvature of the exterior wall.

4. The coolant reservoir tank of claim 3 further comprising a fill bay extending from the fill port, the fill bay including a lower ledge disposed at a maximum design fluid level of the coolant reservoir tank.

5. The coolant reservoir tank of claim 1, wherein the dividing wall is insulated to reduce heat transfer between the first portion and the second portion of the liquid coolant.

6. The coolant reservoir tank of claim 1 further comprising a fluid-separating rib disposed underneath the fill port.

7. The coolant reservoir tank of claim 6, wherein the fluid-separating rib is integral with a cover.

8. The coolant reservoir tank of claim 6, wherein the fluid-separating rib includes a recess disposed therein to create a gap between the dividing wall and the fluid separating rib.

9. The coolant reservoir tank of claim 6, wherein the fluid-separating rib comprises:

a central apex;

a first receding side downwardly extending from the central apex; and a second receding side downwardly extending from the central apex.

10. The coolant reservoir tank of claim 1 further comprising a sump, wherein the sump comprises an internal barrier wall, and one or more openings that fluidly connect the sump to the first compartment and the second compartment.

11. The coolant reservoir tank of claim 5, wherein the dividing wall comprises an opening formed at a lower portion.

12. The coolant reservoir tank of claim 1, wherein the first compartment and the second compartment comprise different volumes.

13. The coolant reservoir tank of claim 4, wherein the first outlet passage extends from the first channel and a second outlet passage extends from the second channel and is positioned opposite to the first outlet passage.

14. The coolant reservoir tank of claim 13, wherein the fill bay is selectively configurable to be in fluid communication with either the first compartment, the second compartment, or both the first and second compartments.

15. A coolant reservoir tank, comprising:

a first compartment configured to receive and retain a first portion of a liquid coolant, wherein the first compartment is configured to be in fluid communication with a first liquid cooling circuit;

a second compartment configured to receive and retain a second portion of the liquid coolant, wherein the second compartment is configured to be in fluid communication with a second liquid cooling circuit;

a dividing wall separating the first compartment from the second compartment, which includes an opening formed at a lower portion thereof;

a fill port;

a fill bay that extends vertically from the fill port and is defined between a central wall and a lower ledge;

a first channel that extends laterally from the fill bay and along a first internal wall, the first channel being fluidly connected to the first compartment; and a second channel that extends laterally from the fill bay and along a second internal wall, the second channel being fluidly connected to the second compartment, wherein the first internal wall wraps around a portion of the first compartment and the second internal wall wraps around a portion of the second compartment.

16. The coolant reservoir tank of claim 15, wherein a first outlet passage curves inwardly from the first channel relative to the fill bay and a second outlet passage curves inwardly from the second channel relative to the fill bay, the first outlet passage and the second outlet passage being oriented toward each other.

17. The coolant reservoir tank of claim 15, wherein the first channel is separated from the first compartment by the first internal wall and the second channel is separated from the second compartment by the second internal wall.

18. The coolant reservoir tank of claim 15, wherein the first internal wall and the second internal wall each extend substantially parallel with and at a distance from an external wall.

19. The coolant reservoir tank of claim 15 further including a sump, wherein the sump comprises an internal barrier wall and one or more openings that fluidly connect the sump to the first compartment and the second compartment.

20. A liquid cooling circuit system for a vehicle, the system comprising:

a first circuit comprising one or more components, wherein one of the components is a battery;

a second circuit comprising one or more components, wherein one of the components is an inverter system circuit; and a coolant reservoir tank for retaining and circulating liquid coolant in relation to the first circuit and the second circuit, the coolant reservoir tank comprising:

a first compartment that is configured to receive and retain a first portion of a liquid coolant, wherein the first compartment is configured to be in fluid communication with the battery, a second compartment that is configured to receive and retain a second portion of the liquid coolant, wherein the second compartment is configured to be in fluid communication with the inverter system circuit, a dividing wall that separates the first compartment from the second compartment, and a fill port including a central passage extending vertically toward a lower ledge in fluid communication with the first compartment and the second compartment, the lower ledge being positioned at a maximum fill level of each of the first and second compartments, wherein a fill channel extends from the fill port and perpendicular to the central passage of the fill port, the fill channel further extending between a first channel and a second channel, wherein the first channel extends toward a first outlet passage that fluidly communicates with the first compartment and the second channel extends toward a second outlet passage that fluidly communicates with the second compartment, and wherein the first outlet passage and the second outlet passage are each spaced apart from the dividing wall and disposed along a nonlinear flow path.

* * * * *